US005296269A

United States Patent [19]

Yang et al.

[11] Patent Number: 5,296,269

[45] Date of Patent: Mar. 22, 1994

[54] PROCESS FOR INCREASING THE CREASE RESISTANCE OF SILK TEXTILES

[75] Inventors: Yiqi Yang; Shiqi Li, both of Urbana, Ill.

[73] Assignee: The Borad of Trustees of the University of Illinois, Urbana, Ill.

[21] Appl. No.: 25,596

[22] Filed: Mar. 3, 1993

[51] Int. Cl.[5] ..... B05D 3/02

[52] U.S. Cl. ..... 427/393.2; 8/128.1; 28/166; 139/1 R; 427/381

[58] Field of Search ..... 427/381, 393.2; 8/128.1; 28/166; 139/1 R

[56] References Cited

U.S. PATENT DOCUMENTS

| | | | |
|---|---|---|---|
| 3,630,659 | 12/1971 | Hendricks et al. | 8/133 |
| 3,632,391 | 1/1972 | Whitfield et al. | 428/272 |
| 3,649,346 | 3/1972 | Bridgeford et al. | 428/262 |
| 3,881,047 | 4/1975 | Massy et al. | 428/378 |
| 4,066,392 | 1/1978 | Abel et al. | 8/127.5 |
| 4,820,307 | 4/1989 | Welch et al. | 8/120 |
| 4,929,248 | 5/1990 | Fuse et al. | 8/127.5 |
| 4,936,865 | 6/1990 | Welch et al. | 8/120 |

OTHER PUBLICATIONS

Texture Asia, Lee et al., vol. 22, No. 12, pp. 86-91.

S. Sundaram, *The Indian Textile Journal*, pp. 138-140, *Some Aspects of Wet Processing of Silk*, Mar. 1990.

*Primary Examiner*—James J. Bell

*Attorney, Agent, or Firm*—Dressler, Goldsmith, Shore & Milnamow, Ltd.

[57] ABSTRACT

An improved silk textile is described which exhibits more desirable wet wrinkle-recovery and tear strength than untreated silk. The silk textile contains polycarboxylic acid cross-links which are relatively strong and resistant to hydrolysis.

A process for manufacturing an improved silk textile is presented which includes wetting an untreated silk textile with a specially formulated finishing agent. The finishing agent includes polycarboxylic acid, a catalyst, and a swelling agent. The wetted silk textile is dried and cured at an elevated temperature.

15 Claims, No Drawings

PROCESS FOR INCREASING THE CREASE RESISTANCE OF SILK TEXTILES

This invention was made with government support from Hatch Funds, 60-370 SHRFS, awarded by the U.S. Department of Agriculture. The Government has certain rights in the invention.

TECHNICAL FIELD

The invention relates to improved silk textiles, and also relates to a process for improving the physical properties of silk textiles.

BACKGROUND OF THE INVENTION

Crease resistant finishing is used to improve the elasticity of many textile fabrics. The finished fabric can have remarkably increased wrinkle resistance and dimension stability, and such wrinkle resistance can persist even after the fabric is machine washed and tumble dried many times.

Amino-formaldehyde (N-methanol) resins have been widely used in crease resistant finishes. Although amino-formaldehyde resins are quite effective in improving crease resistance, they release formaldehyde vapor during their manufacture, while they are in storage, and also when in use by consumers. Formaldehyde vapor irritates human eyes and skin, and is a known carcinogen.

Partly because of the serious health problems associated with formaldehyde, much research is currently directed to developing formaldehyde-free fabric finishes. Most of the research relates to cotton fabrics. The major non-formaldehyde finishes reported for cotton crease-resistant finishing are polycarboxylic acids, for example, citrus acid and butanetetracarboxylic acid (BTCA).

Polycarboxylic acids are said to esterify and cross-link with cellulose fibers of the cotton at elevated temperatures and in the presence of catalysts. Catalysts described for cross-linking cellulose fibers include basic salts selected from the alkali metal dihydrogen phosphates and alkali metal salts of phosphorous, hypophosphorous, and polyphosphoric acids. Polycarboxylic acid cross-linking is said to be applicable to fibrous cellulosic materials such as cotton, flute, jute, hemp, and also for regenerated wood celluloses, such as rayon.

BTCA, a polycarboxylic acid, is said to produce an improvement in the wrinkle recovery and water-washing durability of cotton fabrics. BTCA reportedly exhibits a very low volatility, releases no formaldehyde, and is odorless after cross-linking with the cotton fabric. Additionally, BTCA is reported to have low activity as a skin irritant and low oral and dermal toxicity in animal tests.

Fibers obtained from animals, such as silk, differ substantially from vegetable fibers, such as cotton and hemp. The animal fibers contain keratin and are chemically distinguishable from the cellulose fibers obtained from vegetables. A process for modifying keratinous material has been described which includes treating keratinous fibers with a mixture containing polythiols obtained from carboxylic acids, nitrogen-containing condensation products of epoxides, fatty amines, and dicarboxylic acids and, optionally, stabilizers against the harmful action of light. The process reportedly renders the keratinous material resistant to shrinkage and imparts desirable, durable press characteristics to the material.

A process for improving properties of silk, such as abrasion resistance and light resistance has been reported which involves a cross-linking treatment of silk fiber with epoxy compounds. In the process, the silk fibers are said to be treated with an aqueous solution containing a water-soluble epoxy compound in a catalyst which may be selected from alkali metal or alkali earth metal salts of dicarboxylic acids, tricarboxylic acids, and amino carboxylic acids. The process may include a heat-treating step at temperatures of 50° to 110° C.

Silk textiles are universally popular for use in clothing. They are comfortable to wear and provide an elegant appearance. However, silk textiles generally wrinkle and deform permanently if washed in water. For this reason, silk fabric is said to have a low wet elasticity. Although silk can be dry cleaned, dry cleaning is expensive and is relatively ineffective at removing certain types of stains, for example, perspiration stains.

Chemical finishes are available which improve some of the commercially important properties of silk. For example, glyoxal resin finishes with ethylene urea are reported to produce a silk textile having good crease-recovery, particularly when used with a metal-acid catalyst. Also, urethane resins with or without formaldehyde are said to be suitable for producing machine-washable silk. Generally, the resins are applied from an aqueous bath on a stenter, dried, and cured at about 150° C.

It has been reported that epoxides, siloxanes, aminoplasts and glyoxal can be dispersed in a sodium-hydroxide solution and applied to silk textiles to increase the washability of the textiles. Similarly, others have reportedly applied hydroxymethylmethacrylamine to improve crease-resistance and dimensional stability. Others are said to employ a combination of glycerol and ammonium chloride to increase wrinkle recovery.

A process for preventing damage to fibers of natural protein-containing fiber materials has been reported which employs water soluble polyamides. Polyamides are said to be produced by reacting aliphatic polyamines with a polycarboxylic acid. The natural protein-containing fibers can be wool, silk, vegetable, or synthetic fiber materials. The process is said to preserve wet tear-resistance of fibers that are immersed in an aqueous acidic medium, such as a dye solution.

However, the wide appeal of silk textiles for use in clothing is based on several commercially important properties. Improving one or two of the properties, at the expense of others, does not fulfill a perceived need for silk textiles that are comfortable and elegant, as well as machine-washable. Among the properties which consumers have come to expect in silk, are ease in handling, dimensional stability under both wet and dry conditions, resistance to slipping, elasticity, soft flowing drape, freedom from water spots, resistance from ultraviolet light, and flame retardancy.

A need currently exists for a formaldehyde-free silk finishing process which can improve the crease-resistance of silk textiles without significantly decreasing the strength or the tear resistance of the textiles. A silk finishing process which provides both crease-resistance and durability is desired.

SUMMARY OF THE INVENTION

The invention provides an improved silk textile and a process for manufacturing the textile from silk fibers. The process includes a treating step in which a monobasic acid, a polycarboxylic acid, and a phosphorous-containing salt catalyst interact with the silk fibers to produce relatively strong cross-linking bonds which resist creasing hydrolysis.

In one aspect, the invention is a process for improving the crease resistance of silk textiles. A silk textile is wetted with a finishing agent, dried, and cured at an elevated temperature. The finishing agent comprises a carboxylic acid and a phosphorous-containing salt. The salt catalyzes a reaction of carboxylic acid with proteins in the silk fibers which tends to produce a relatively durable textile. The finishing agent preferably also comprises a polyhydroxyl alkyl amine or a monobasic acid to swell the fibers and to enhance penetration of the finishing agent within the fibers.

In another aspect, the invention is a crease-resistant silk textile formed by interwoven silk fibers. Some of the fibers have been cross-linked by a dehydration reaction with polycarboxylic acid. The textile exhibits a wet wrinkle recovery after one washing of more than about 260 degrees, as determined by the American Association of Textile Chemists and Colorists (AATCC) Test Method 66-1984. The textile has a tear strength in the range of about 50% to about 100% greater, as compared to a similar textile without cross-linked fibers. Even after 50 washings, the textile continues to possess desirable wet wrinkle recovery and durable press ratings.

DETAILED DESCRIPTION OF THE INVENTION

A crease-resistant silk textile in accordance with the invention is formed by interwoven silk fibers. Silk is a fiber obtained as a filament from a cocoon produced by a silkworm. The silkworm can be a larva of the Chinese silkworm moth, *Bombyx mori*. Alternatively, the silkworm can be a larva of any of several moths of the family Saturniidae.

A textile is any cloth or goods produced by weaving, knitting, or felting. Materials such as fiber or yarn which are suitable for weaving are also textiles. Herein, a silk textile is a textile that contains more than about 50% by weight of silk fibers.

Interwoven fibers are those which have been interlaced to form a fabric, or alternatively, twisted to form thread or yarn. In the silk textile of the present invention at least some of the silk fibers are cross-linked with others of the silk fibers by products of a dehydration reaction between protein molecules of the silk fibers and a polycarboxylic acid. The polycarboxylic acid may be saturated or unsaturated.

Representative polycarboxylic saturated acids which are suitable for use in the invention include citric acid, 1,2,3,4-butanetetracarboxylic acid, 1,1,2-ethanetricarboxylic acid, propane-1,1,3-tricarboxylic acid, tricarballylic acid, butane-1,2,4-tricarboxylic acid, butane-1,1,4-tricarboxylic acid, pentane-1,3,4-tricarboxylic acid, pentane-1,3,5-tricarboxylic acid, heptane-1,2,4-tricarboxylic acid, methanetetracarboxylic acid, ethane-1,1,2,2-tetracarboxylic acid, methylenebismalonic acid, ethylidenebismalonic acid, butane-1,1,4,4-tetracarboxylic acid, pentane-1,1,5,5-tetracarboxylic acid, propane-1,1,2,3-tetracarboxylic acid, propane-1,2,2,3-tetracarboxylic acid, butane-1,1,3,4-tetracarboxylic acid, pentane-2,2,3,4-tetracarboxylic acid, methanetetracetic acid, propylene-1,1,3,3-tetracarboxylic acid, polyacrylic acids (with or without hydroxyl groups) with a degree of polymerization equal to or larger than 3, and cyclopentanetetracarboxylic acid. Representative unsaturated polycarboxylic acids include aconitic acid, ethylenetetracarboxylic acid, itaconic acid, and maleic acid. 1,2,3,4-butanetetracarboxylic acid (BTCA) and citric acid are preferred.

The polycarboxylic acid is introduced to the silk fibers as a component of a finishing agent. Preferably the finishing agent is an aqueous solution which contains in the range of about 4 weight percent to about 9 weight percent of the polycarboxylic acid, and most preferably about 6 weight percent to about 7 weight percent, based on the weight of the finishing agent.

The finishing agent also comprises a phosphorous-containing salt catalyst. Phosphorous-containing salts which are suitable for use in the invention are preferably alkali metal salts of phosphinic acid, preferably sodium hypophosphite ($NaH_2PO_2$). The catalyst should be present in the finishing agent in an amount in the range from about 2 weight percent to about 8 weight percent, most preferably about 3.3 weight percent to about 6.0 weight percent, based on the weight of the finishing agent. Sodium hypophosphite, commercially available in the form of sodium hypophosphite monohydrate crystals, is an especially preferred catalyst. It is believed that the catalyst influences the dehydration reaction between polycarboxylic acid and proteins in the silk fibers to produce cross-linking bonds which are relatively more resistant to hydrolysis. The hydrolysis-resistant cross-linking bonds contribute to the strength and water washability of the silk textile.

It is preferred that the finishing agent also contain a swelling agent, for example, a monobasic acid, an amide, and/or a halide salt, in an effective amount. Monobasic acids which are suitable for use in the present invention include formic acid, acetic acid, and propionic acid, with formic acid being preferred. Suitable amides are urea and formamide. Suitable halide salts include ammonium bromide, lithium bromide, lithium chloride.

The swelling agent functions to break hydrogen bonds and salt linkages between fibroin polymers and brings water into the pores to expand the silk fibers so that the finishing agent more fully penetrates the silk fibers. Carboxylic acids of relatively low molecular weight are more effective for this purpose than previously known swelling agents, such as for example, triethanol amine. Therefore, carboxylic acids with relatively low molecular weight, such as formic acid, are preferred.

Herein, an effective amount of swelling agent is an amount sufficient to produce an observable enlargement in the width of the silk fibers. The enlargement is determined by visual inspection using a microscope. Preferably, the swelling agent is present in the range of about 0.1 weight percent to about 10 weight percent, most preferably about 4 weight percent to about 8 weight percent, based on the weight of the finishing agent.

The finishing agent also contains multi-alcohol amines, which enhance the penetration of the finishing agent into the silk fibers. Multi-alcohol amines which are suitable for use in the present invention include diethanolamine, triethanolamine, diisopropanolamine, triisopropanolamine, di-sec-butanolamine, tri-sec-butanolamine, methyldiethanolamine, and ethyldiethanolamine, preferably triethanol amine. It is preferred that the multi-alcohol amines be present in the range of about 0.1 weight percent to about 5 weight percent, most preferably about 2.0 weight percent, based on the weight of the finishing agent.

Optionally, the finishing agent may contain a softening agent. Softening agents which are suitable for use in the present invention include nonionic softeners such as polyolefins, and silicones, preferably an aqueous emulsion of polyethylene. An example of a suitable softening agent is Protolube TM, a nonionic polyethylene emulsion softener (27% solid) which is commercially available from National Starch and Chemical Corporation.

In the process of the present invention the silk textile is preferably wetted by at least one complete immersion in liquid finishing agent. More preferably, the silk textile is repeatedly dipped into the finishing agent. Thereafter, the textile is dried at about 60° C. to about 120° C., preferably about 80° C., for a period of time of about 1 minute to about 30 minutes, preferably about 5 minutes.

The dried textile is cured at an elevated temperature. For example, hot air or a hot cylinder can be used to apply the necessary heat. Preferably, the curing temperature is in the range of about 130° C. to about 180° C. The curing temperature is maintained for about 0.5 to about 20 minutes. Alternatively, the curing can be induced by exposing the dried textile to radiation, such as infrared or microwave radiation. Initiators can be included in the finishing agent to accelerate the curing process.

After the silk textile has been cured, it may optionally be washed and dried one or more times before use.

EXAMPLE 1

A silk textile having improved crease-resistance was manufactured by the following method. An untreated silk fabric was dipped twice into a vat containing a finishing agent in accordance with the present invention. After each dipping, the fabric was squeezed between two rollers to partially expel the finishing agent. The finishing agent was an aqueous solution containing 6 weight percent BTCA, 3.3 weight percent sodium hyphophosphite, and 0.5 weight percent of a softener (Protolub TM PE).

In the course of the dipping the textile picked up about 94% to about 98% of the finishing weight, based on original weight of the untreated textile. The silk textile was then dried at 80° C. for 5 minutes. Thereafter, the textile was cured at 180° C. for 90 seconds. The cured textile was designated Textile A.

EXAMPLE 2

Another sample of silk fabric, identical to that described in Example 1 above, was produced by the method described in Example 1. However, the finishing agent contained an additional component. Specifically, formic acid present in the amount of 8.0 weight percent based on the weight of the finishing agent was included in the finishing agent and, accordingly, the finishing agent contained slightly less water. After curing, the sample so produced was designated Textile B.

EXAMPLE 3

A third sample of silk fabric, identical to those utilized in Examples 1 and 2 above, was processed to produce a silk textile in accordance with the invention. This time the finishing agent contained 6.0 weight percent BTCA, 3.3 weight percent sodium hypophosphate, 0.5 weight percent Protolube TM PE, 4.0 weight percent formic acid, and 2.0 weight percent triethanol amine, with the balance being water. The cured sample was designated Textile C.

EXAMPLE 4

A finishing agent was provided which contained 7 weight percent citric acid, in place of BTCA with was employed in Examples 1 through 3. The finishing agent also contained 6.0 weight percent sodium hypophosphate, 0.5 weight percent Protolube TM PE, 4.0 weight percent formic acid, and 2.0 weight percent triethanol amine.

A method substantially similar to that described in Example 1 was performed, except that the sample was cured at 170° C. for about 3 minutes.

EXAMPLE 5

Samples A through D as described above were washed in a Kenmore 70 washing machine on delicate cycle at a temperature of 50° C. An amount of American Association of Textile Chemists and Colorists (AATCC) Standard Detergent No. 124 sufficient to produce a concentration of 2 grams per liter was added to the wash cycle.

A liquor-to-goods ratio of 25 to 1 was employed in the wash cycle. The pH of the wash water was 10.0. Thereafter, each sample was dried in a Kenmore 70 drying machine for a period of 40 minutes.

After drying, each sample was tested for wrinkle recovery degree, break strength retained, tear strength retained, and whiteness index. Test results for textiles A through D, as well as the test results for an untreated control fabric, are presented in Table 1 below.

The abbreviation "Cond" in Table 1 denotes that the fabric has been conditioned by storing in a 21° C. atmosphere having a relative humidity of 65% for 48 hours before testing. The test was conducted in a similar atmosphere. Also, W% and F% refer to the percent of tear or break strength retained in the warp (W) or filling (F) direction of the fabric, respectively. Strength retained after finishing is expressed as a percentage of the original strength of the fabric.

TABLE 1

| | | Physical Properties of Finished Fabrics | | | | | | |
|---|---|---|---|---|---|---|---|---|
| | Weight Added | WRD (W + F)[a] | | BSR[b] | | TSR[c] | | WI |
| Example | % | Cond | Wet | W % | F % | W % | F % | CIE[d] |
| A | 7.88 | 311 | 263 | 92.01 | 81.82 | 211.3 | 205.0 | 56.6 |
| B | 7.13 | 309 | 263 | 96.85 | 89.01 | 227.6 | 218.7 | 59.4 |
| C | 11.03 | 298 | 280 | 93.46 | 87.73 | 152.1 | 156.9 | 61.6 |
| D | 9.53 | 282 | 295 | 98.55 | 89.32 | 180.3 | 141.3 | 51.3 |

TABLE 1-continued

| Example | Weight Added % | WRD (W + F)[a] Cond | WRD (W + F)[a] Wet | BSR[b] W % | BSR[b] F % | TSR[c] W % | TSR[c] F % | WI CIE[d] |
|---|---|---|---|---|---|---|---|---|
| Control[e] | 0 | 277 | 208 | 100 | 100 | 100 | 100 | 75.7 |

[a]Wrinkle Recovery Degree (Warp + Filling) measured by American Association of Textile Chemists and Colorists (AATCC) 66-1984
[b]Break Strength Retained, measured by American Society for Testing and Materials (ASTM) D 1682-64
[c]Tear Strength Retained, measured by ASTM 1424-63
[d]Whiteness Index, measured by Commission Internationale de l'Enclairage (CIE) Standard
[e]Untreated Fabrics, BSR: 41.31b(W), 44.01b(F); TSR: 710g (F)

Inspection of Table 1 reveals that textiles A through D, in accordance with the present invention, exhibited a wet wrinkle-recovery after one washing of more than about 260 degrees. By contrast, the control sample exhibited a wet wrinkle-recovery of only 208 degrees. Therefore, the process of the present invention can produce a significant increase in the wet wrinkle-recovery of silk textiles. Additionally, these improved wet wrinkle-recoveries were achieved simultaneously with an increase in the range of about 50% to about 120% in tear strength, as compared to the simultaneously with an increase in the range of about 50% to about 120% in tear strength, as compared to the untreated control sample. The break strength retained and whiteness index values of textiles A through D are only slightly less than those measured for the untreated control sample. The dry wrinkle recovery, after conditioning, also improved in that the wrinkle recovery of the finished fabrics increased from 277° (W+F) to as much as 311° (W+F).

EXAMPLE 6

The samples produced in Examples 1 through 4 were subjected to many more washings and periodically portions of the samples were tested for wrinkle-recovery. The wet and dry wrinkle-recovery values observed are presented in Table 2 after 10, 20, and 40 wash cycles. The data in Table 2 demonstrates that the improvement in wrinkle-recovery produced by the present invention persists throughout many washing cycles. For example, even after 50 washings the dry wrinkle-recovery degree of each of the four sample textiles A through D exhibited a more desirable degree of wrinkle-recovery than did the control sample after one washing.

TABLE 2

| W[a] | 10 | | 20 | | 30 | | 40 | | 50 | |
|---|---|---|---|---|---|---|---|---|---|---|
| Ex. | Cond | Wet | Cond | Wet | Cond | Wet | Cond | Wet | Cond | Wet |
| A | 301 | 255 | 298 | 259 | 298 | 234 | 294 | 232 | 298 | 230 |
| B | 289 | 263 | 295 | 243 | 296 | 245 | 294 | 245 | 297 | 247 |
| C | 292 | 263 | 311 | 270 | 293 | 264 | 295 | 258 | 297 | 266 |
| D | 289 | 272 | 295 | 273 | 302 | 271 | 297 | 261 | 305 | 255 |

[a]Wrinkle Recovery Degree (Warp + Filling) measured by AATCC 66-1984
[a]W = Washing Times Samples of portions of textiles A through D were also subjected to durable press rating testing throughout the 50 wash cycles. The durable press rating test is designed for evaluating the smoothness appearance of fabrics after repeated home launderings. It is primarily intended for evaluation of durable press fabrics. The term "durable press" is used to describe a fabric which requires minimum care after laundering to restore it to a wearable or usable condition. The durable press rating values observed are reported in Table 3.

TABLE 3

| Washed | 10 | 20 | 30 | 40 | 50 |
|---|---|---|---|---|---|
| A | 3.6 | 3.9 | 3.5 | 3.7 | 3.5 |
| B | 3.8 | 3.8 | 3.8 | 3.4 | 3.3 |
| C | 4.0 | 3.8 | 3.7 | 3.6 | 3.6 |
| D | 3.9 | 3.2 | 3.2 | 3.3 | 3.5 |

*Durable Press Rating, measured by AATCC 124-1984

Table 3 shows that the improved silk textile of the present invention exhibits a relatively high and constant durable press rating over many washing cycles.

The above Examples and hypotheses have been presented to communicate the invention. They are not intended to limit the scope of the invention, which is governed by the appended claims. The scope of the invention is intended to include additional, similar aspects of the invention which will become readily apparent to practitioners in the art after they have enjoyed the teachings of the present specification.

What is claimed is:

1. A process for increasing the crease-resistance of silk textiles, which comprises:
   wetting a silk textile with a finishing agent comprising a polycarboxylic acid and a phosphorus-containing salt catalyst;
   drying the textile; and
   curing the textile at an elevated temperature.

2. The process of claim 1 wherein sad phosphorous-containing salt is an alkali metal salt of phosphinic acid.

3. The process of claim 1 wherein said finishing agent further comprises a polyhydroxyl alkyl amine.

4. The process of claim 1 wherein said finishing agent also comprises an effective amount of a swelling agent.

5. The process of claim 1 wherein said drying is maintained at about 60° C. to about 120° C. for a period of time of about 1 to about 30 minutes.

6. The process of claim 1 wherein said curing is a temperature in the range of about 130° C. to about 180° C. and is maintained for about 0.5 to about 20 minutes.

7. The process of claim 1 wherein said finishing agent further comprises a multi-alcohol amine.

8. A process for increasing the crease-resistance of silk textiles, which comprises:

wetting a silk textile with a finishing agent comprising a polycarboxylic acid, a phosphorus-containing salt catalyst, a multi-alcohol amine and a swelling agent;

drying the textile; and curing the textile at an elevated temperature.

9. A process for increasing the crease-resistance of a silk textile, which comprises:

wetting silk fibers with a finishing agent comprising a polycarboxylic acid and a phosphorus-containing salt catalyst;

drying the fibers;

curing the fibers at an elevated temperature; and forming the fibers into a fabric.

10. The process of claim 9 wherein said finishing agent also comprises an effective amount of a swelling agent.

11. The process of claim 9 wherein said finishing agent also comprises a multi-alcohol amine.

12. The process of claim 9 wherein the fibers are formed into a fabric by weaving.

13. The process of claim 9 wherein the fibers are formed into a fabric by knitting.

14. The process of claim 9 wherein the fibers are formed in a fabric by felting.

15. The process of claim 9 wherein said fibers are yarns.

* * * * *